US008328462B2

(12) United States Patent
Beh

(10) Patent No.: US 8,328,462 B2
(45) Date of Patent: Dec. 11, 2012

(54) SAFETY MARKER WITH CONVECTION FAN

(76) Inventor: Thomas P. Beh, Corona del Mar, CA (US)

( * ) Notice: Subject to any disclaimer, the term of this patent is extended or adjusted under 35 U.S.C. 154(b) by 0 days.

(21) Appl. No.: 12/877,431

(22) Filed: Sep. 8, 2010

(65) Prior Publication Data

US 2011/0058898 A1 Mar. 10, 2011

Related U.S. Application Data

(60) Provisional application No. 61/240,804, filed on Sep. 9, 2009.

(51) Int. Cl.
*E01F 9/011* (2006.01)

(52) U.S. Cl. ..... 404/9; 34/88; 116/63 C; 116/63 P; 116/63 R

(58) Field of Classification Search ..... 404/9, 12; 116/63 C, 63 P, 63 R, 63 T; 34/88, 90
See application file for complete search history.

(56) References Cited

U.S. PATENT DOCUMENTS

| | | | | |
|---|---|---|---|---|
| 3,132,624 | A | 5/1964 | Shoemaker, Jr. | |
| 5,208,940 | A * | 5/1993 | London et al. | 15/345 |
| 6,615,508 | B1 * | 9/2003 | Valle | 34/201 |
| 2003/0115783 | A1 | 6/2003 | Woosley | |
| 2007/0022939 | A1 | 2/2007 | Stokes | |
| 2007/0157485 | A1 | 7/2007 | Andrisin et al. | |
| 2008/0271338 | A1 * | 11/2008 | Muir et al. | 34/201 |

OTHER PUBLICATIONS

Search Report and Written Opinion for application No. PCT/US2010/048276.

* cited by examiner

*Primary Examiner* — Raymond W Addie
(74) *Attorney, Agent, or Firm* — Stetina Brunda Garred & Brucker

(57) ABSTRACT

In accordance with the present invention, there is provided is a safety marker with an on-board convection fan for marking areas/hazards to be avoided while concurrently producing a convection effect upon the adjacent, surrounding surfaces so as to enhance evaporation of liquids/moisture thereon. Along these lines, the safety marker will not only mitigate risks by allowing for the marking of an area to be avoided, but also, uniquely, by accelerating the elimination of what is most often the root cause of the risk; wetness on the floor.

20 Claims, 5 Drawing Sheets

SAFETY MARKER WITH CONVECTION FAN

CROSS-REFERENCE TO RELATED APPLICATIONS

This application claims priority to U.S. Provisional Patent Application Ser. No. 61/240,804 entitled SAFETY MARKER WITH INTEGRAL BATTERY OPERATED CONVECTION FAN filed Sep. 9, 2009.

STATEMENT RE: FEDERALLY SPONSORED RESEARCH/DEVELOPMENT

Not Applicable

BACKGROUND OF THE INVENTION

1. Field of the Invention

The present invention relates generally to safety devices and, more particularly, to a safety marker with a convection fan for marking areas to be avoided while concurrently producing a convection effect upon all surrounding floor areas so as to enhance the evaporation of liquids thereon.

2. Description of the Related Art

Safety markers specifically suited for use on floors or in other prescribed interior or exterior areas have been in use for years. Typically, safety markers are objects used for marking off areas to be temporarily avoided. Currently known safety markers come in various sizes and shapes ranging from small cones to large traffic safety barrels.

Three basic types of safety markers are typical for use within and around buildings and other pedestrian based facilities. These include collapsible safety markers which are made of fabric and are collapsible to allow for storage within flat or tubular containers, foldable safety markers which are typically of plastic construction and foldable upon a top mounted hinge to allow for flat storage against a wall, and stackable safety markers which are typically of plastic or rubber construction and are tapered like a cone to enable stacking for efficient storage of multiple markers.

Safety markers are typically of a bright color to enhance their visibility. Some have provisions for connecting a sign or a battery operated flashing light to enhance their visibility further. In addition to having a shape and color conducive to drawing attention, most safety markers include written warnings or visual depictions of danger printed on their external surfaces. Such warnings act to communicate the dangers inherent to the area that a safety marker is marking to be avoided. Apart from safety markers used for highway safety applications, safety markers used within and around pedestrian based facilities are most often used for applications involving wet surfaces to be avoided by the public. Wet surfaces (primarily floors) are commonly marked by safety markers in restaurants, grocery stores, factories, shopping malls, and other areas where foot traffic is prevalent and spills may occur. Their purpose is generally to prevent people from coming into contact with the wet surface so as to prevent tracking of the wetness throughout the facility and, more importantly, slips and falls due to the slippery surface caused by the wetness. Accordingly, by reducing the possibility of slips and falls in a facility, the proprietor of such facility will typically reduce their liabilities associated with wet floors and the slips and falls they may cause.

One deficiency with conventional safety markers is that they typically do nothing to improve the condition of the area over which they are being used to mark as dangerous. They merely mark or cover the area. In the case of a wetted area being marked, the area will remain wet until evaporation removes the wetness. In this regard, the marker itself does not contribute to the evaporation process in any way.

Accordingly, there is a need in the art for a safety marker configured to alert pedestrians of nearby hazards, while at the same time introducing forced convection for drying a wetted area of the underlying surface. These and other advantages attendant to the present invention will be described in more detail below.

BRIEF SUMMARY OF THE INVENTION

In accordance with the present invention, there is provided a safety marker with a convection fan for marking areas/hazards to be avoided while concurrently producing a convection effect upon the adjacent surfaces (e.g., floors) so as to enhance evaporation of liquids/moisture thereon. Along these lines, the safety marker will not only mitigate risks by allowing for the marking of an area to be avoided, but also, uniquely, by accelerating the elimination of what is most often the root cause of the risk, i.e., wetness on the floor.

According to one implementation, the safety marker includes a portable housing having a fluid intake and a fluid exhaust, wherein the housing is configured to be disposable on a surface having a hazard and/or a wetted area. A convection fan is disposable within the housing and is configured to direct fluid radially outward to dry the wetted surface.

The portable housing may include an upper body and a lower body selectively engageable with the upper body. The lower body may include a base and a plurality of inlet fins extending from the base, wherein the inlet fins are sized and configured to align the upper body with the lower body and to frictionally engage with the upper body. The fluid intake may be formed by a space between the upper body and the lower body base, while the fluid exhaust may be formed by a space between the base and the underlying support surface. A plurality of exhaust fins may be disposed between the base and the support surface to facilitate a more even air distribution across the support surface.

The fan may be powered by a rechargeable battery. The battery may be disposed within a battery receptacle coupled to the upper body and electrically connectable with the fan via an internal wire. When the power within the battery is drained, the battery may be recharged by a battery charger having the wiring and transformer needed for converting AC power from a conventional wall outlet to the DC power generally required to charge the battery.

Another implementation of the present invention is directed toward a drying unit configured for use with a conventional safety marker. The drying unit includes a base and a fan connected to the base to create a fluid flow. The drying unit is configured to engage with and support a conventional safety marker to perform the dual functionality of alerting nearby pedestrians of potential hazards while concurrently drying an adjacent wetted area to mitigate risk of a slip and fall injury.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
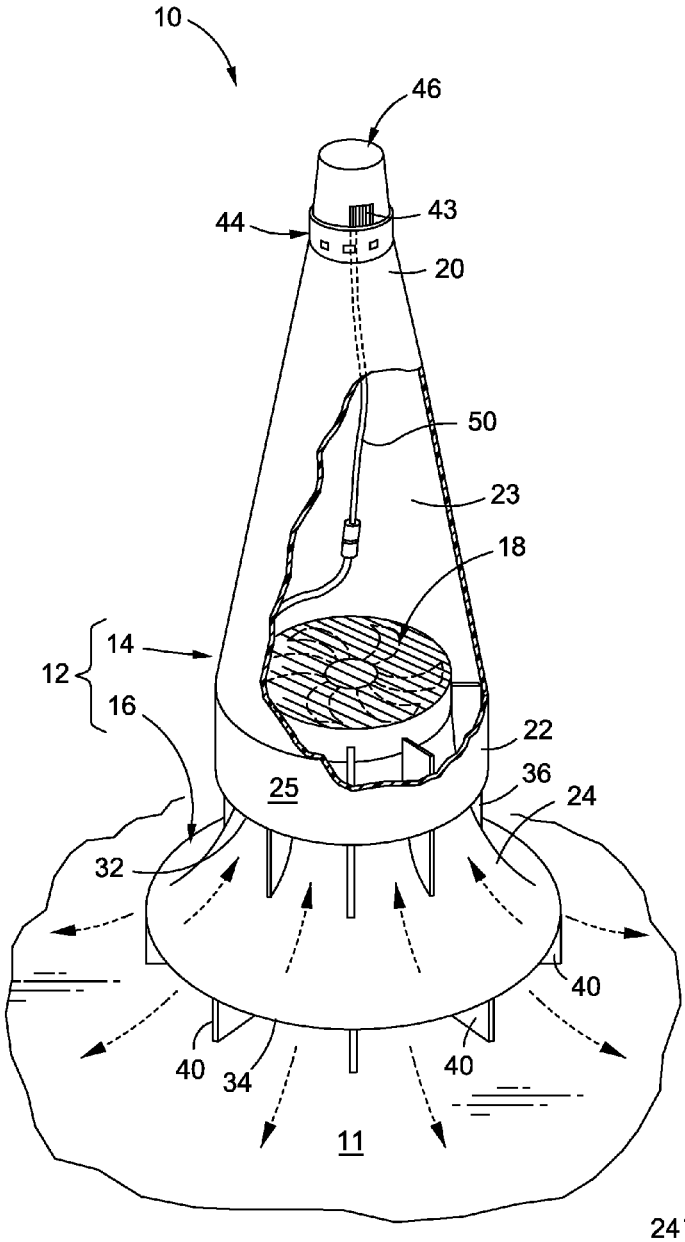
FIG. 1 is a top perspective view of a portable safety marker and drying device for marking a hazard and drying a liquid disposed on a surface.
Figure 2:
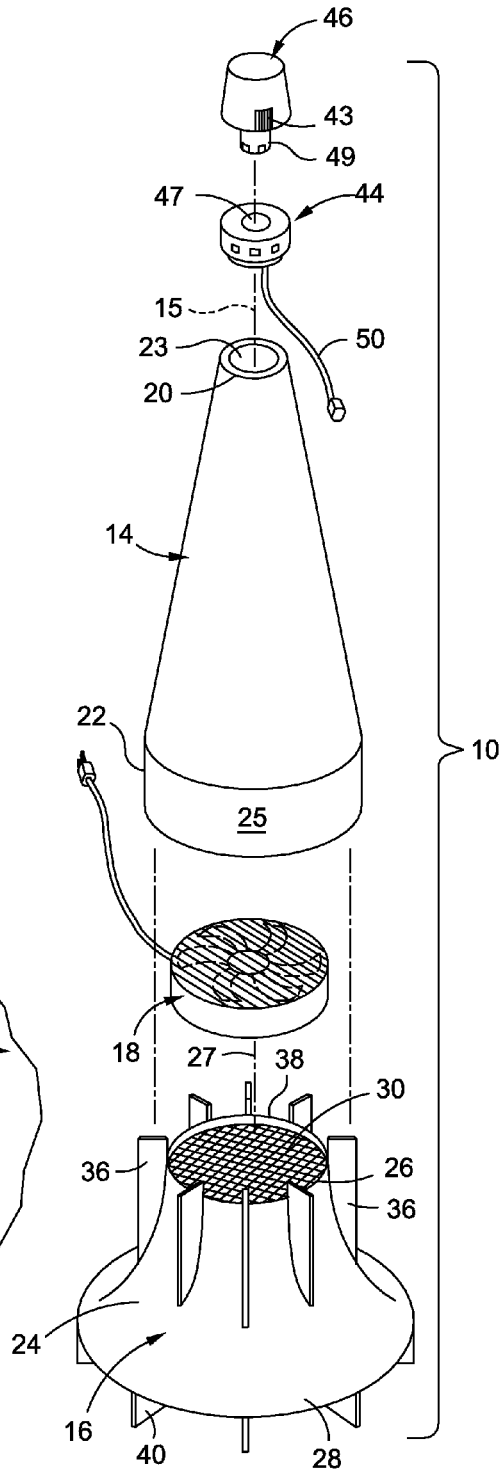
FIG. 2 is an exploded top perspective view of the portable safety marker and drying device depicted in FIG. 1.

Referring now to the drawings, wherein the showings are for purposes of illustrating preferred embodiments of the present invention, and not for purposes of limiting the same, there is shown in FIGS. 1 and 2 a portable safety marker drying device 10 for marking the location of a hazard on a surface 11, such as a wet surface 11, wherein the safety marker drying device 10 is additionally configured to dry the surface 11 to reduce the likelihood of injury which may be caused by the wet surface 11, i.e., a slip and fall. The safety marker drying device 10 is believed to be more desirable than conventional markers because the device 10 is configured to create a fluid flow to dry the wet surface 11 via convection. Therefore, the device 10 may be placed on the wet surface 11 to not only alert pedestrians of the presence of liquid on the surface 11, but also to direct air over the surface 11 to more quickly dry the wet surface 11.

Figure 3:
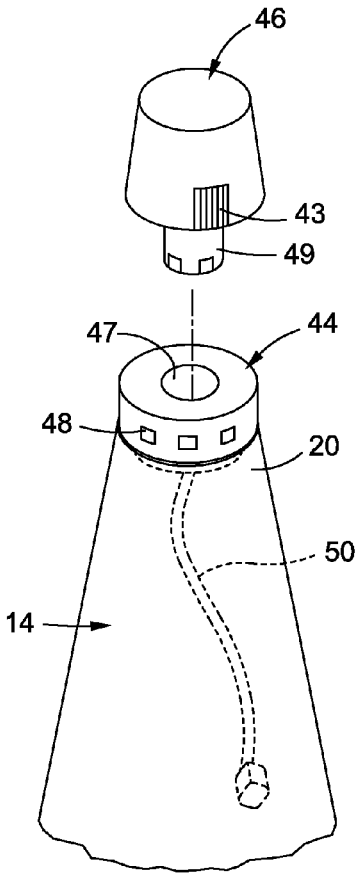
FIG. 3 is an enlarged view of an upper portion of the portable safety marker and drying device depicting a battery receptacle and removable battery engageable therewith.

Referring now specifically to FIGS. 1-3, there is depicted a first embodiment of the safety marker drying device 10 including a portable housing 12 comprised of an upper body 14 and a lower body 16. The device 10 further includes a fan 18 disposable within the portable housing 12 to generate the drying force. In this regard, the housing 12 defines a fluid flow path where air is supplied to the fan 18 and is then exhausted from the housing 12 over the surface 11 to dry liquid disposed thereon. In this regard, air is exhausted from the housing 12 in a plane substantially parallel to the surface 11.

The upper body 14 may be configured to define a variety of shapes and sizes; however, in the embodiment shown in FIGS. 1-3, the upper body 14 has a generally frusto-conical shape defining and thus disposed about an upper axis 15 (see FIG. 2). The upper body 14 includes a first end portion 20 and an opposing second end portion 22, and also defines a hollow interior chamber 23 (see FIG. 2) extending between the first end portion 20 and the second end portion 22. The diameter of the upper body increases from the first end portion 20 toward the second end portion 22, with the second end portion 22 including a cylindrical collar 25 that is of substantially uniform diameter. The device 10 is configured to be disposable on the surface 11 to assume an upright configuration wherein the first end portion 20 is disposed further from the surface 11 than the second end portion 22.

The upper body 14 may be configured to alert nearby pedestrians of hazards present on the surface 11. In this regard, the upper body 14 may be of a bright color (orange/yellow) or include wording (i.e., "CAUTION" or "WET SURFACE"), symbols, or other indicia displayed on an exterior surface thereof to denote nearby hazards.

According to one implementation, the upper body 14 is configured to be removably engageable with the lower body 16. The lower body 16 includes a base 24 defining and thus disposed about a lower axis 27 (see FIG. 2). The lower body 16 also defines a first end portion 26 and an opposing second end portion 28, as well as a hollow interior chamber 30 extending between the first end portion 26 and the second end portion 28. The base 24 defines an arcuate (e.g., concave) surface which circumvents the lower axis 27 and extends between the first end portion 26 and the second end portion 28, wherein the arcuate surface has an outer diameter which increases from the first end portion 26 toward the second end portion 28. The outer diameter of the first end portion 26 of the lower body 16 is preferably smaller than the outer diameter of the second end portion 22 of the upper body 14 to allow a portion of the lower body 16 to be received into the upper body 14. Along these lines, the outer diameter of the second end portion 28 of the lower body 16 is preferably larger than the outer diameter of the upper body 14 to provide stable support for the upper body 14.

The housing 12 defines a fluid intake 32 and a fluid exhaust 34 to create a fluid flow for drying the liquid disposed on the underlying surface 11. Air is drawn into the housing 12 through the fluid intake 32 and is expelled from the housing 12 through the fluid exhaust 34 to dry the surface 11. In the embodiment shown in FIGS. 1-2, the fluid intake 32 is defined by a gap between the base 24 and the upper body 14. Disposed within this gap is a plurality of inlet fins 36 which extend from the arcuate surface of the base 24 in a direction generally parallel to the lower axis 27. The inlet fins 36 are disposed in spaced relation to each other (preferably at equidistant intervals) and frictionally engage with the upper body 14 to align and secure the upper body 14 to the lower body 16. As is best depicted in FIG. 2, the inlet fins 36 preferably extend above an upper edge 38 of the base 24 to collectively define a containment area for the fan 18, as described in more detail below.

The fluid exhaust 34 is in fluid communication with the fluid intake 32 via the hollow interior 30 of the base 24, and is defined by a gap or space between the base 24 and the surface 11 upon which the device 10 is positioned. Disposed within such gap is a plurality of exhaust fins 40 which protrude from a lower surface of the base 24. Like the fins 36, the fins 40 extend from the base 24 in a direction generally parallel to the lower axis 27. The fins 40 are disposed in spaced relation to each other (preferably at equidistant intervals) and are sized and arranged to be rested directly upon the surface 11 to support the base 24 in spaced relation to such surface 11. In this regard, the fins 40 preferably each include a distal edge or surface, such distal surfaces residing on a common plane. The fins 40 additionally facilitate a more even air distribution over the underlying surface 11 when the device 10 is in operation.

In an exemplary embodiment, the upper body 14 and lower body 16 have a combined height of approximately 24-36 inches, although those of ordinary skill in the art will appreciate that the upper and lower bodies 14, 16 may be of other sizes without departing from the spirit and scope of the present invention. Furthermore, the upper body 14 and lower body 16 are preferably formed from an injection molded plastic; however, other materials may be used without departing from the spirit and scope of the present invention. In addition, the upper body 14 and/or the lower body 16 may be configured to enable stacking of a plurality of upper bodies 14 of identical or approximate shape.

The fan 18 of the device 10 is disposed within the containment area defined by the plurality of inlet fins 36. As such, as viewed from the perspective shown in FIG. 2, the fan 18 resides on top of the base 24. The fan 18 has an outer diameter smaller than the diameter of the second end portion 28 of the base 24, the outer ends of the fins 40 terminating at and being substantially flush with the second end portion 28. In this respect, the outer diameter of the fan 18 is preferably substantially equal to the outer diameter of the base 24 at the upper edge 38 such that when the fan 18 is disposed within the containment area, the outer surface of the fan is substantially flush with the upper end portion 26 of the base 24. A screen or wire mesh 42 may extend across the upper end portion 26 to cover one end of the hollow interior 30 to support the fan 18 and to prevent external objects from making contact with the outlet side of the fan 18. The fan 18 may be connected to the housing 12 via mechanical fasteners such as screws, rivets, and the like.

The fan 18 is configured to create the above-described fluid flow through the housing 12. In this regard, when the fan 18 is on, fluid (air) is drawn into the housing 12 though the fluid intake 32. The fan 18 pulls air into the hollow interior 23 of the upper body 14 and forces the air out through the hollow interior 30 of the lower body 16 where it exits through the fluid exhaust 34. The fan 18 may be operable at different speeds to create convection forces at different magnitudes.

According to one implementation, the fan 18 is powered by battery to allow for remote positioning of the device 10 (i.e., the fan 18 does not need to be plugged into a wall outlet; although it is contemplated that other embodiments of the fan 18 may include a power cord that is pluggable into a wall outlet to receive power). Therefore, the device 10 includes a battery receptacle 44 electrically connectable with the fan 18 and engageable with a rechargeable battery 46. The battery receptacle 44 includes a neck 49 configured to extend partially into the hollow interior 23 of the upper body 14 to secure the battery receptacle 44 adjacent the first end portion 20 thereof. The battery receptacle 44 defines a cavity 47 which is sized to receive and engage with a complimentary stem 49 formed on the rechargeable battery 46. The cavity 47 includes internal electrical contacts which mate with external electrical contacts on the stem 49 when the battery 46 is connected to the battery receptacle 44. The battery 46 may include a finger actuated, spring-loaded retainer 43 to secure the battery 46 to the receptacle 44. Actuating the retainer 43 disengages the battery 46 from the receptacle 44 allowing a user to remove the battery 46 from the receptacle 44.

The battery 46 may be configured to supply power to the fan 18 upon engagement with the battery receptacle 44. In this regard, the battery 46 may continuously supply power to fan 18 until the power is completely drained from the battery 46 or until the battery 46 is disengaged from the receptacle 44. Alternatively, the battery receptacle 44 may include an ON/OFF switch for controlling the operation of the fan 18. Additionally, the battery receptacle 44 may be equipped with a variable speed control switch allowing for the creation of convection forces of different magnitudes via the fan 18. A wire 50 extends internally between the battery receptacle 44 and the fan 18 to communicate power from the battery receptacle 44 to the fan 18.

Figure 4:
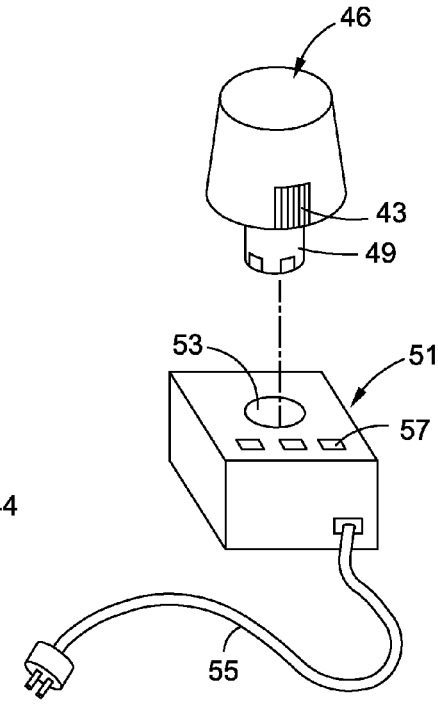
FIG. 4 is a top perspective view of the battery shown in FIG. 3 and a corresponding battery charger.

Referring now specifically to FIGS. 3 and 4, the battery receptacle 44 preferably includes one or more battery charge indicator LED lights 48 to provide a visual indication as to the power level or strength of the battery 46. When the power level is low, the battery 46 may be disengaged from the battery receptacle 44 and connected with a power charger 51 to recharge the battery 46, as described in more detail below. The power charger 51 includes a cavity 53 sized to receive and engage with the stem 49 to recharge the battery 46, as well as a cord 55 to plug the charger 51 into a wall outlet to receive power therefrom. The charger 51 incorporates the wiring and transformer needed for converting AC power from a wall outlet to DC power required to charge the battery 46. Charger indicator lights 57 indicate the power level of the battery 46 as it is getting charged. When the battery 46 is completely charged, it may be removed from the charger 51 and replaced on the battery receptacle 44. While the battery 46 is being charged by the power charger 51, a battery backup may be connected to the receptacle 44 to provide power to the fan 18.

According to one embodiment, the device 10 may include a timer in operative communication with the LED lights 48 to illuminate the LEDs 48 for a specified period of time. For instance, if a particular floor (i.e., a bathroom floor) is routinely cleaned or mopped, the cleaning staff may know that it takes a certain period of time for that floor to dry (i.e., fifteen minutes). Therefore, the timer may be set for fifteen minutes to illuminate the LEDs 48 for alerting nearby pedestrians that the floor is wet. The timer may be powered by the battery 46 when the battery is coupled to the battery receptacle 44.

Figure 6:
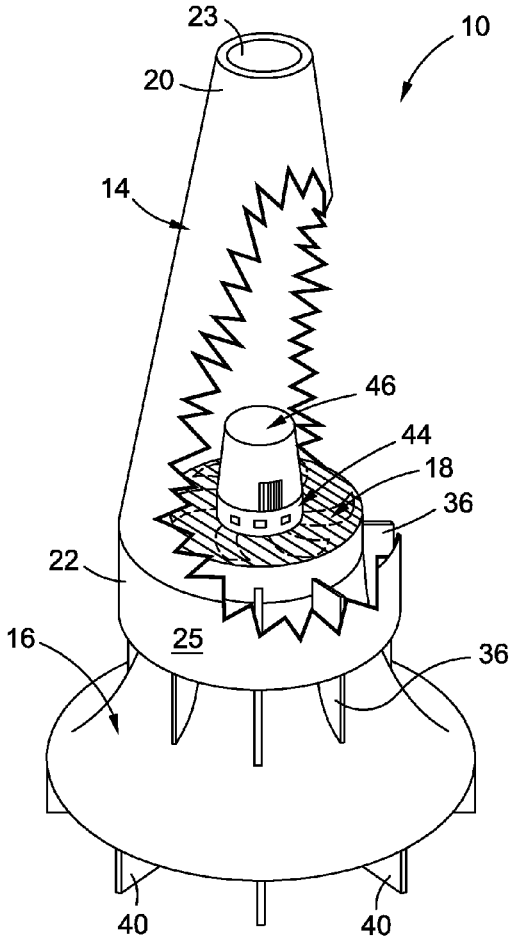
FIG. 6 is a top perspective, partial cutaway view of a third embodiment of a portable safety marker and drying device including a battery connectable directly to a fan.

Referring now to FIG. 6, it is also contemplated that the battery receptacle 44 may be integrated directly into the fan 18 to eliminate the need of an external cord extending between the battery 46 and the fan 18. Furthermore, this configuration may advantageously conceal the battery 46 if there is a concern that the battery 46 may be tampered with.

Figure 5:
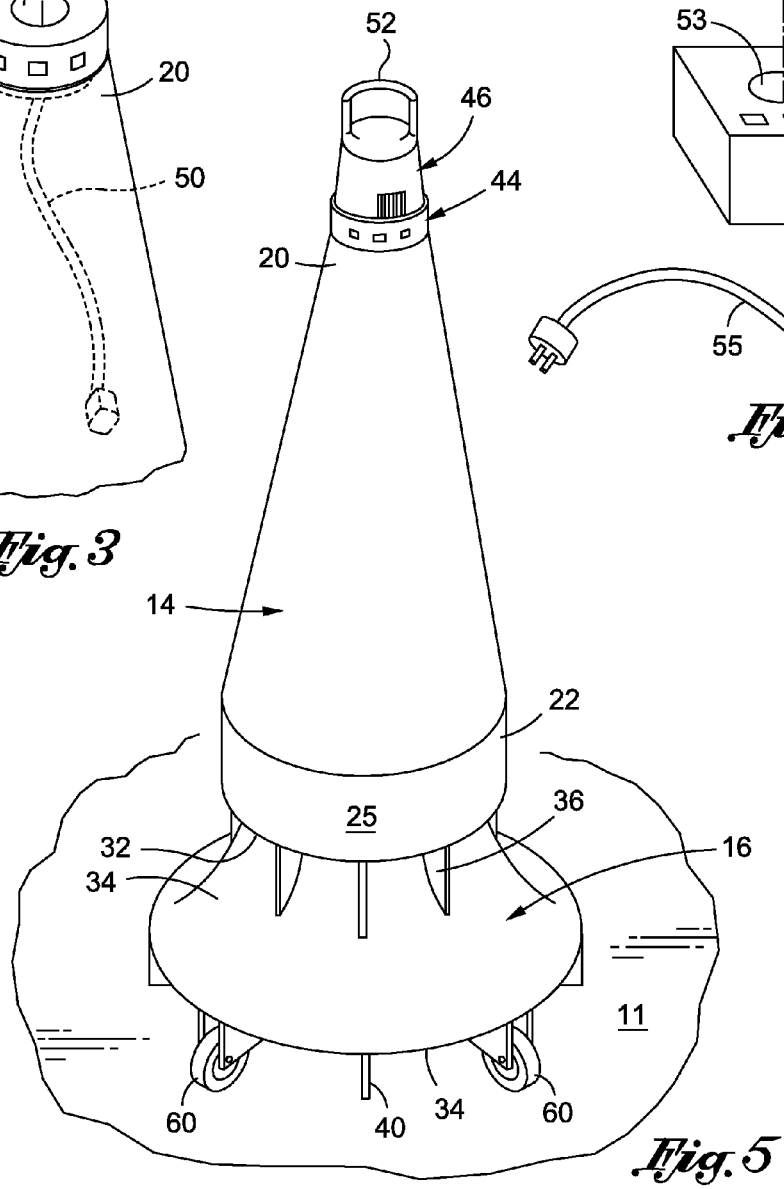
FIG. 5 is a top perspective view of a second embodiment of a portable safety marker and drying device including a plurality of casters to facilitate movement of the marker.

Referring now back to FIG. 5, it is contemplated that the safety marker drying device 10 may include structural features intended to facilitate the movement of the device 10. It is contemplated that the weight of the device is small enough to allow a single person to lift and carry the device; however, the size and shape of the device 10 may make it difficult to complete such a task. Therefore, certain embodiments may include structural features to facilitate movement of the device 10 without carrying the device. For instance, the device 10 may include one or more wheels or castors 60 connected to the housing 12 to allow a user to roll the device 10 along a surface. The castors 60 may be of the swivel construction type and coupled to the underside of the outer diameter of the second end portion 28 of the lower body 16, and in particular the base 24 thereof. While the use of a plurality of casters 60 allows for movement of the device 10 across the surface 11, the use of casters 60 having a predetermined resistance to rotation or having a locking mechanism integral to their design may be included to maintain the device 10 in a desired position. Alternatively, a separate braking device that is not integrated to the casters 60 may be included to maintain the device 10 in a desired position. As seen in FIG. 5, the device 10 may additionally include a handle 52 to provide a location where a user may easily grip the device 10 for movement thereof. As depicted in the drawings, the handle 52 is connected to the battery 46; however, it is understood that the handle 52 may be connected to other portions of the device 10, such as the upper body 14 or the battery receptacle 44, without departing from the spirit and scope of the present invention.

Figure 7:
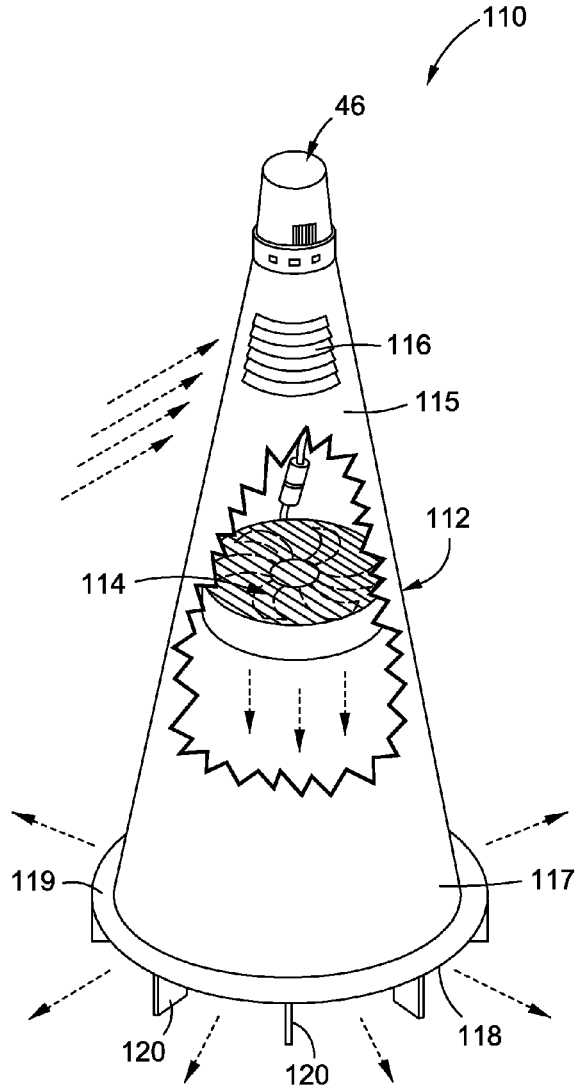
FIG. 7 is a top perspective, partial cutaway view of a fourth embodiment of a portable safety marker and drying device including a single housing body.

Referring now to FIG. 7, there is depicted another embodiment of the safety marker drying device 110 including a single, unitary housing 112. In this regard, the primary distinction between the device 110, and the device 10 discussed above, is that the device 10 includes a housing 12 having an upper body 14 and a separate lower body 16, whereas the device 110 is comprised of only the housing 112. The housing 112 includes an upper end portion 115 and an opposing lower end portion 117. A flange 119 may be disposed about the lower end portion 117 to provide stability and support. The housing 112 defines both a fluid intake 116 and a fluid exhaust 118 in fluid communication with the fluid intake 116 to facilitate fluid flow through the device 110. The fluid intake 116 is formed by a series of slots extending through the housing 112 into fluid communication with the hollow interior thereof. The fluid exhaust 118 is defined by a space or gap disposed between the housing 112 and the surface upon which the housing 112 is positioned. A plurality of exhaust fins 120 having structural and functional characteristics mirroring those of the fins 40 described above in relation to the device 10 may be coupled to the housing 112 to dispose the housing 112 in spaced relation to the underlying support surface to define the fluid exhaust 118.

A fan 114 is disposed within the interior of the housing 112, and in the intended path of fluid flow therethrough, such that the fluid intake 116 is disposed upstream of the fan 114 and the fluid exhaust 118 is disposed downstream of the fan 114. The housing 112 may include tabs, a flange, a shelf, etc., against which the fan 114 may be coupled. The fan 114 may be battery operated, similar to the fan 18 discussed above.

Figure 8:
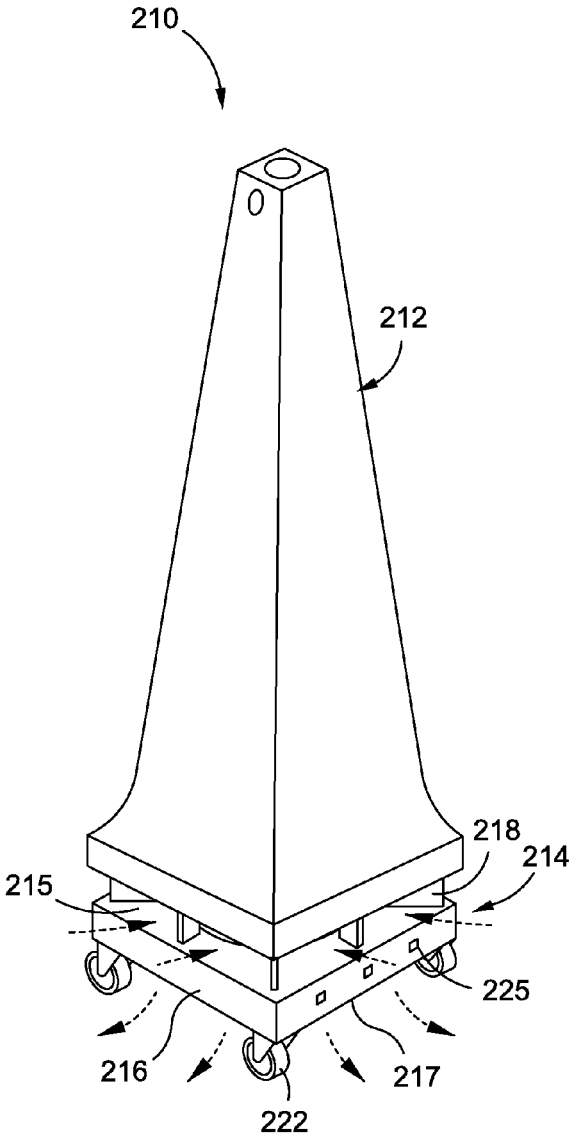
FIG. 8 is a top perspective view of a sixth embodiment of a portable safety marker and drying device.
Figure 9:
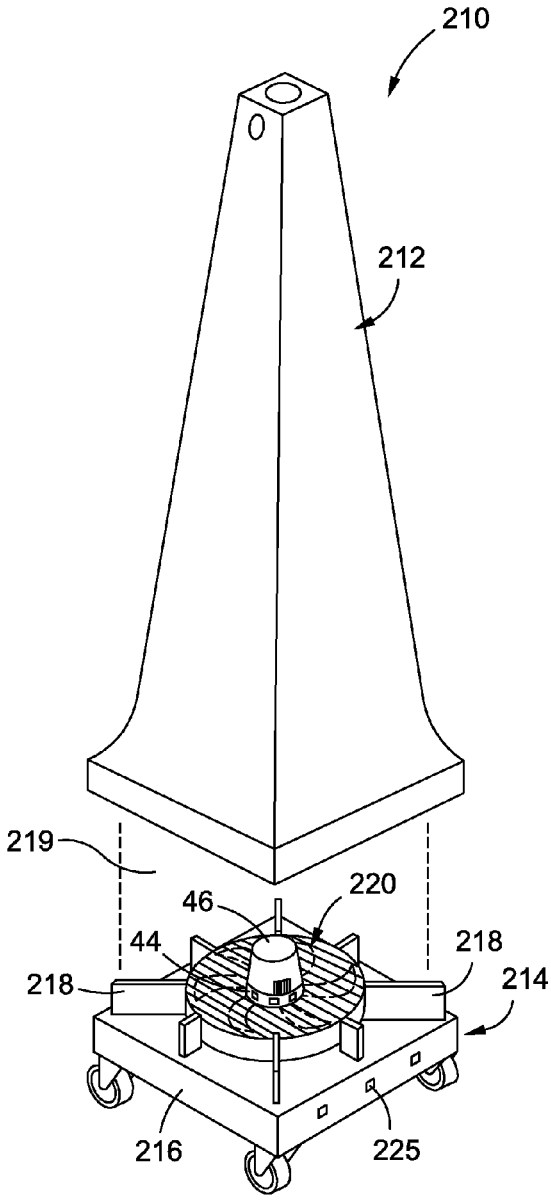
FIG. 9 is an exploded top perspective view of the portable safety marker and drying device depicted in FIG. 8.

Referring now to FIGS. 8-9, there is shown a further embodiment of the safety marker drying device 210 which is specifically configured to integrate a conventional safety marker 212 therein. In this regard, the device 210 includes a drying unit 214 upon which a conventional safety marker 212 may be placed. The drying unit 214 includes a base 216 and a plurality of inlet fins 218 configured to engage with the conventional safety marker 212 to dispose the safety marker 212 in spaced relation to the base 216. In this regard, the inlet fins 218 collectively define a surface configured to support the safety marker 212. The space or gap between the safety marker 212 and the base 216 defines a fluid intake 215. The drying unit 214 is configured to dispose the base 216 in spaced relation to the underlying support surface to define a fluid exhaust 217. The drying unit 214 may include one or more casters 222 or fins like the above-described fins 40 to maintain the base 216 in spaced relation to the underlying support surface. The casters 222 may facilitate movement of the device 210. The fluid intake 215 and fluid exhaust 217 are in fluid communication with each other. In this regard, the base 216 may include an opening to facilitate such fluid communication.

A fan 220 is connected to the base 216 to draw air through the fluid intake 215 and to force air through the fluid exhaust 217 upon the engagement of the safety marker 212 to the base 216. However, it is understood that the fan 220 and base 216 are able to draw air through the unobstructed fluid intake zone 219 above the fan 215 and to force air through the fluid exhaust 217 even without engagement of the safety marker 212 to the base 216, thus allowing for the drying unit 214 to be similarly integrated to other items such as a mop bucket or cart. The inlet fins 218 may define a containment area within which the fan 220 may be placed. The fan 220 may be battery powered, as described in detail above.

The base 216 may include one or more LED battery indicator lights 225 to indicate the power level of the battery. As such, when the battery is connected to the fan 220, the battery is additionally placed in electrical communication with the base 216 to allow the base 216 to provide a visual indication of the power level of the battery.

Figure 10:
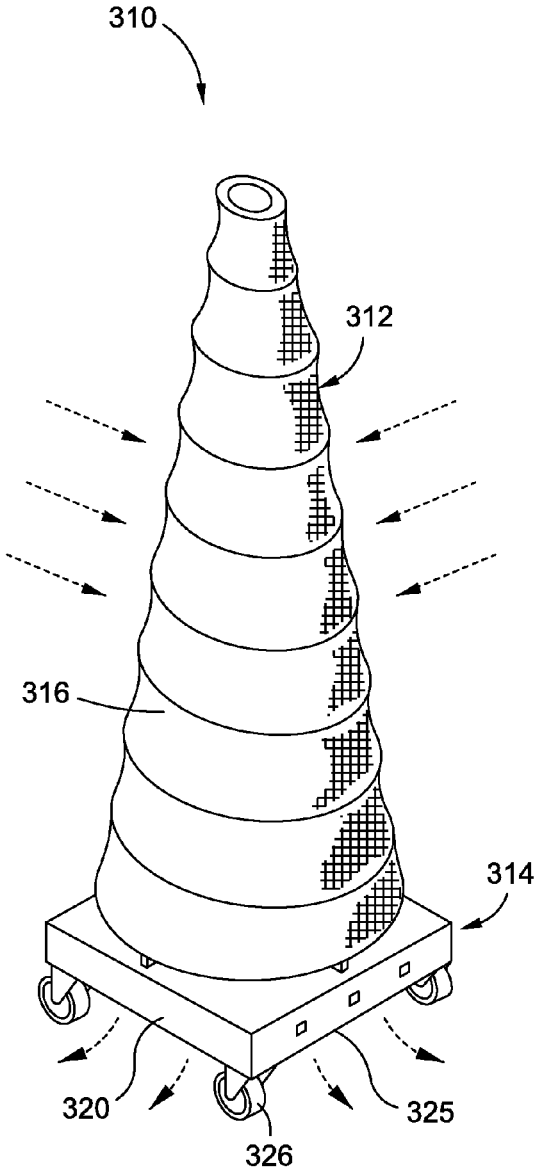
FIG. 10 is a top perspective view of a fifth embodiment of a portable safety marker and drying device including a portion formed from a collapsible and breathable material.
Figure 11:
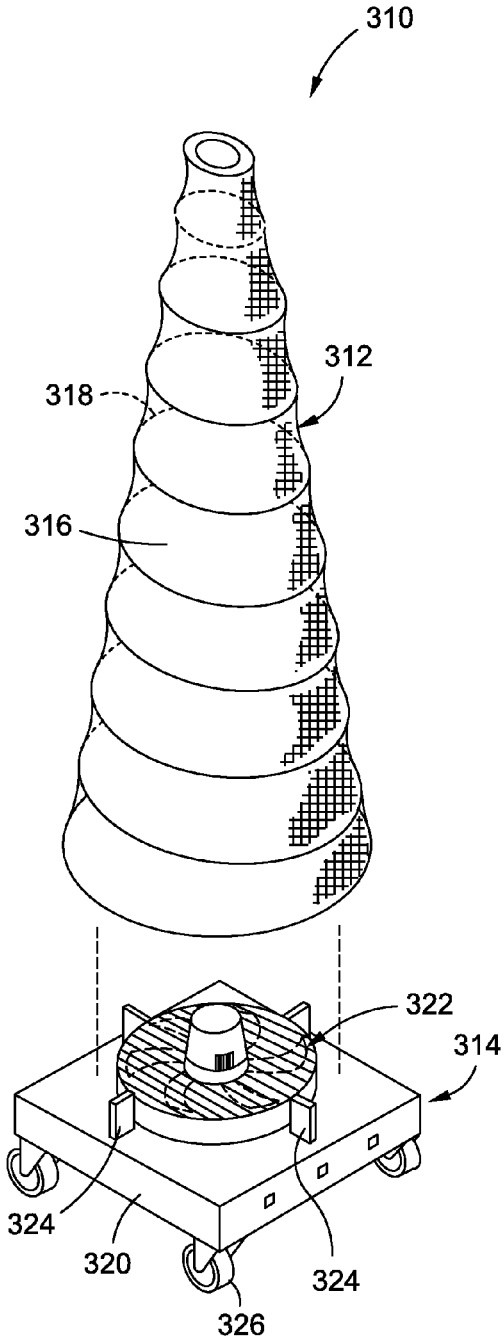
FIG. 11 is an exploded top perspective view of the portable safety marker and drying device depicted in FIG. 10.

Referring now to FIGS. 10 and 11, there is depicted an additional embodiment of the safety marker drying device 310 including a breathable safety marker 312 and a drying unit 314. The breathable marker 312 is formed from a breathable fabric shell 316 (i.e., nylon) and a spring-loaded, collapsible, spiraling conical wire frame 318. In this regard, the breathable marker 312 may be disposed in a deployed position (as shown in FIGS. 10 and 11) as well as a collapsed position to facilitate storage or transport thereof. The drying unit 314 includes a base 320 having a fan 322 connected thereto. The drying unit 314 is similar to the drying unit 214 discussed above. The fan 322 is configured to draw air through the breathable fabric shell 316 and force air through an exhaust 325 disposed between the base 320 and the surface upon which the base 320 is supported. A plurality of fins 324 are connected to the base 320 and define a containment area within which the fan 322 is positioned. The fins 324 may also be configured to facilitate the frictional engagement with the breathable marker 312. A plurality of castors 326 may be connected to a base 320 to facilitate movement thereof.

This disclosure provides exemplary embodiments of the present invention. The scope of the present invention is not limited by this exemplary embodiment. Numerous variations, whether explicitly provided for by the specification or implied by the specification, such as variations in structure, dimension, type of material and manufacturing process may be implemented by one of skill in the art in view of this disclosure.

What is claimed is:

1. A portable safety marker drying device for marking and drying a liquid on a support surface, the portable safety marker drying device comprising:

a portable housing including an upper body and a lower body detachably coupled to each other, the lower body including a base having a concave arcuate surface which is of an increasing diameter in a direction extending away from the upper body, the housing having a fluid intake and a fluid exhaust, the housing being sized and configured to be positionable on the support surface to mark a hazard thereon; and a fan disposable within the housing, the fan and housing collectively being configured to direct fluid radially outward from the housing.

2. The portable safety marker drying device recited in claim 1, wherein the upper body has a generally frusto-conical shape.

3. The portable safety marker drying device recited in claim 1, wherein the lower body includes a base having a hollow interior and defining a lower axis, the arcuate surface circumventing the lower axis.

4. The portable safety marker drying device recited in claim 3, wherein the lower body includes a plurality of inlet fins disposed within the fluid intake and extending from the arcuate surface in a direction generally parallel to the lower axis.

5. The portable safety marker drying device recited in claim 4, wherein the upper body is configured to frictionally engage the plurality of inlet fins.

6. The portable safety marker drying device recited in claim 3, wherein the lower body includes a plurality of exhaust fins which are disposed within the fluid exhaust and positionable upon the support surface.

7. The portable safety marker drying device recited in claim 1, wherein the fluid intake includes a fluid permeable portion of the upper body.

8. The portable safety marker drying device recited in claim 7, wherein the fluid permeable portion includes a porous fabric shell.

9. The portable safety marker drying device recited in claim 1, wherein the upper body extends away from the lower body to define a first end portion, the device further comprising:

a battery receptacle connected to the upper body at the first end portion thereof and electrically connectable to the fan; and a battery detachably engageable with the battery receptacle, the battery being electrically connectable to the fan via the battery receptacle to provide power to the fan when the battery is engaged with the battery receptacle.

10. The portable safety marker drying device recited in claim 1, wherein the device includes warning indicia displayed thereon.

11. The portable safety marker drying device recited in claim 1, further comprising a plurality of castors coupled to the housing to facilitate movement thereof upon the support surface.

12. The portable safety marker drying device recited in claim 1, wherein the fan is sized and configured to be detachable from and selectively removable from within the housing.

13. The portable safety marker drying device recited in claim 4, wherein the lower body defines an upper edge, the plurality of inlet fins extend beyond the upper edge to define a containment area within which the fan is positioned.

14. The portable safety marker drying device recited in claim 9, wherein:

the battery receptacle includes a neck configured to extend into the upper body to secure the battery receptacle thereto; and the lower body, the battery receptacle, and the battery are configured such that the battery remains exposed when the upper body is connected to the lower body.

15. A safety marker drying device for use on a wetted surface, the safety marker drying device comprising:

a safety marker housing; and a drying unit including a base, a plurality of inlet fins coupled to the base, and a fan connectable with the base, the inlet fins being configured to engage with the safety marker housing to orient the safety marker housing in spaced relation to the base, and the fan being configured to generate a fluid flow;

wherein the drying unit and safety marker housing collectively define a flow path between a fluid inlet and a fluid exhaust for exhausting fluid over the wetted surface.

16. The safety marker drying device recited in claim 15, wherein the safety marker housing is disposed in spaced relation to the base when connected therewith to define the fluid inlet.

17. The safety marker drying device recited in claim 15, wherein the base is disposed in spaced relation to the wetted surface to define the fluid exhaust.

18. The safety marker drying device recited in claim 15, further comprising a plurality of castors connected to the drying unit.

19. A drying unit configured for use with a safety marker for drying a wetted surface, the drying unit comprising:

a base defining a fluid flow path extending between a fluid inlet and a fluid exhaust for exhausting fluid over the wetted surface, the base having a concave arcuate surface which is of an increasing diameter in a downstream direction, the base being configured to support the safety marker; and a fan connectable with the base, the base configured to be engageable with the safety marker housing, the fan being configured to generate a fluid flow along the fluid flow path.

20. The portable safety marker drying device recited in claim 19, wherein the base defines an upper edge, the plurality of inlet fins extend beyond the upper edge to define a containment area within which the fan is positioned.

* * * * *